US007693431B2

(12) United States Patent
Eda et al.

(10) Patent No.: US 7,693,431 B2
(45) Date of Patent: Apr. 6, 2010

(54) IMAGE FORMING APPARATUS AND CONTROL METHOD THEREFOR

(75) Inventors: Hiroyuki Eda, Moriya (JP); Kenji Kuroki, Toride (JP); Hiroaki Tomiyasu, Toride (JP); Takashi Fujimori, Moriya (JP); Eiichi Motoyama, Tokyo (JP)

(73) Assignee: Canon Kabushiki Kaisha (JP)

( * ) Notice: Subject to any disclaimer, the term of this patent is extended or adjusted under 35 U.S.C. 154(b) by 155 days.

(21) Appl. No.: 11/949,757

(22) Filed: Dec. 3, 2007

(65) Prior Publication Data

US 2008/0131144 A1 Jun. 5, 2008

(30) Foreign Application Priority Data

Dec. 4, 2006 (JP) ..... 2006-327115

(51) Int. Cl.
*G03G 15/00* (2006.01)

(52) U.S. Cl. ..... 399/9; 399/24; 399/25

(58) Field of Classification Search ..... 399/9, 399/12, 13, 18, 24, 25, 26, 27, 38, 49, 107, 399/111
See application file for complete search history.

(56) References Cited

U.S. PATENT DOCUMENTS 5,909,603 A * 6/1999 Suzuki et al. ..... 399/13
6,137,966 A * 10/2000 Uehara et al. ..... 399/13
7,273,165 B2 * 9/2007 Satake et al. ..... 235/375
7,505,698 B2 * 3/2009 Morimoto ..... 399/12
2006/0152775 A1 7/2006 Itoyama et al.

FOREIGN PATENT DOCUMENTS

| | | | |
|---|---|---|---|
| CN | 1757000 | A | 4/2006 |
| JP | 06-205186 | A | 7/1994 |
| JP | 2002-341708 | A | 11/2002 |
| JP | 2004-093693 | A | 3/2004 |
| JP | 2005-077525 | A | 3/2005 |
| JP | 2005-107113 | A | 4/2005 |
| JP | 2006-220920 | A | 8/2006 |

* cited by examiner

*Primary Examiner*—Hoan H Tran
(74) *Attorney, Agent, or Firm*—Rossi, Kimms & McDowell LLP

(57) ABSTRACT

An image forming apparatus which is capable of performing a failsafe image forming operation even when a memory device of a replaceable unit mounted thereon is faulty. A controller of the image forming apparatus determines whether or not a memory tag of a toner cartridge is faulty. If the memory tag is determined to be faulty, the controller causes image adjustment to be executed.

6 Claims, 8 Drawing Sheets

IMAGE FORMING APPARATUS AND CONTROL METHOD THEREFOR

BACKGROUND OF THE INVENTION

1. Field of the Invention

The present invention relates to an image forming apparatus, such as a color copying machine and a printer, which forms an image on a recording sheet by an electrophotographic printing method, and a control method therefor.

2. Description of the Related Art

Conventionally, in an image forming apparatus, such as a copying machine, a facsimile machine, and a printer, toners or developing materials are filled in respective cartridges (replaceable units) removable from the apparatus body, and these cartridges are mounted on the image forming apparatus, whereby the toners or developing materials are supplied to the image forming apparatus. Then, when any of the toners or developing materials in the cartridges runs out, the corresponding cartridge is replaced by a new one, whereby the tone or developing material is replenished.

Recently, as a means for detecting replacement of the existing cartridge by a new one or a depletion of a toner or developing material, there has been proposed a cartridge with a memory tag (memory device). By causing cartridge identification information, life information, image processing information, etc. to be stored on the memory tag, it is possible to grasp the latest state of the cartridge and perform the optimum image formation (see e.g. Japanese Laid-Open Patent Publications No. 2004-093693 and No. 2005-107113).

However, in the conventional technique, if a memory tag is faulty due to some cause, it is impossible to perform a failsafe image forming operation. Therefore, the user is required to procure a cartridge again, which can cause a marked degradation of working efficiency.

SUMMARY OF THE INVENTION

The present invention provides an image forming apparatus and a control method therefor which is capable of performing a failsafe image forming operation even when a memory tag (memory device) of a cartridge (replaceable unit) mounted on the image forming apparatus is faulty.

In a first aspect of the present invention, there is provided an image forming apparatus on which a replaceable unit equipped with a memory device storing information is removably mounted, comprising a failure determination unit configured to determine whether or not the memory device is faulty, and an image adjustment unit configured to execute image adjustment if it is determined by the failure determination unit that the memory device is faulty.

The image forming apparatus according to the first aspect of the present invention comprises a failure determination unit for determining whether or not the memory device is faulty, and an image adjustment unit for executing image adjustment if it is determined by the failure determination unit that the memory device is faulty. Therefore, even if a cartridge (replaceable unit) equipped with a memory tag (memory device) is mounted, it is possible to perform a failsafe image forming operation.

After setting a plurality of image forming conditions different from each other which are set when a predetermined inspection pattern image in which image density is stepwise varied is formed on a photosensitive member, the image adjustment unit can correct the image forming conditions based on results of reading of the inspection pattern image formed on a recording medium.

The failure determination unit can determine whether or not the memory device is communicable or not, or stores garbled data or not.

In a second aspect of the present invention, there is provided an image forming apparatus on which a replaceable unit equipped with a memory device storing information is removably mounted, comprising a failure determination unit configured to determine whether or not the memory device is faulty, and an image adjustment-recommending unit configured to recommend image adjustment if it is determined by the failure determination unit that the memory device is faulty.

The image forming apparatus according to the second aspect of the present invention comprises a failure determination unit for determining whether or not the memory device is faulty, and an image adjustment-recommending unit for recommending image adjustment if it is determined by the failure determination unit that the memory device is faulty. Therefore, even if a cartridge (replaceable unit) equipped with a memory tag (memory device) is mounted, it is possible to perform a failsafe image forming operation.

After setting a plurality of image forming conditions different from each other which are set when a predetermined inspection pattern image in which image density is stepwise varied is formed on a photosensitive member, the image adjustment unit can correct the image forming conditions based on results of reading of the inspection pattern image formed on a recording medium.

The failure determination unit can determine whether or not the memory device is communicable or not, or stores garbled data or not.

In a third aspect of the present invention, there is provided a method of controlling an image forming apparatus on which a replaceable unit equipped with a memory device storing information is removably mounted, comprising a failure determination step of determining whether or not the memory device is faulty, and an image adjustment step of executing image adjustment if it is determined in the failure determination step that memory device is faulty.

In a fourth aspect of the present invention, there is provided a method of controlling an image forming apparatus on which a replaceable unit equipped with a memory device storing information is removably mounted, comprising a failure determination step of determining whether or not the memory device is faulty, and an image adjustment-recommending step of recommending image adjustment if it is determined in the failure determination step that the memory device is faulty.

The features and advantages of the invention will become more apparent from the following detailed description taken in conjunction with the accompanying drawings.

DETAILED DESCRIPTION OF THE PREFERRED EMBODIMENTS

The present invention will now be described in detail below with reference to the accompanying drawings showing preferred embodiments thereof.

Figure 1:
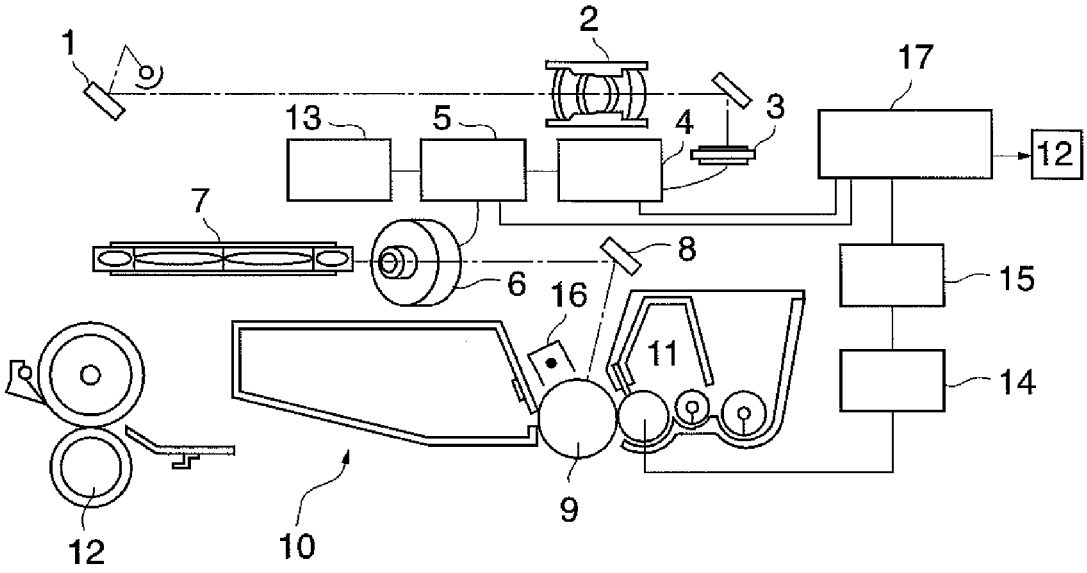
FIG. 1 is a schematic diagram of essential parts of an image forming apparatus according to an embodiment of the present invention.

FIG. 1 is a schematic diagram of essential parts of an image forming apparatus according to an embodiment of the present invention.

As shown in FIG. 1, an illumination device 1 for illuminating an original includes a traveling unit including a halogen lamp, and illuminates the original as the traveling unit travels. An optical system 2 projects an image of an original (original image) onto an image pickup sensor 3, such as a CCD. In the present embodiment, the image pickup sensor 3 reads the image at a resolution of 400 to 600 DPI, and coverts the read image into a digital image signal of 8 bits, for example. That is, the image pickup sensor 3 is configured to be capable of reading an image with a 256-step gradation.

A look-up table (LUT) 4 performs conversion between the read image signal and an output image signal. A laser driver circuit 5 drives a semiconductor laser unit 6 according to the digital image signal. A laser beam emitted from the semiconductor laser of the semiconductor laser unit 6 is deflected by a rotational polygon mirror 7, and is emitted onto a photosensitive drum 9 via a mirror 8.

An electrophotographic image forming unit 10 is comprised of a developing unit 11, and a fixing unit 12. The image signal generation unit 13 is configured to be capable of generating a desired image signal in a desired pattern. A developing bias power supply 14 outputs a developing bias. An eight-bit D/A converter 15 controls the output from the developing bias power supply 14.

A primary electrostatic charger 16 uniformly charges the surface of the photosensitive drum 9. A controller 17 is comprised of a CPU, a ROM, and a RAM, and collectively controls an image forming sequence and an image formation condition-setting sequence.

Figure 2:
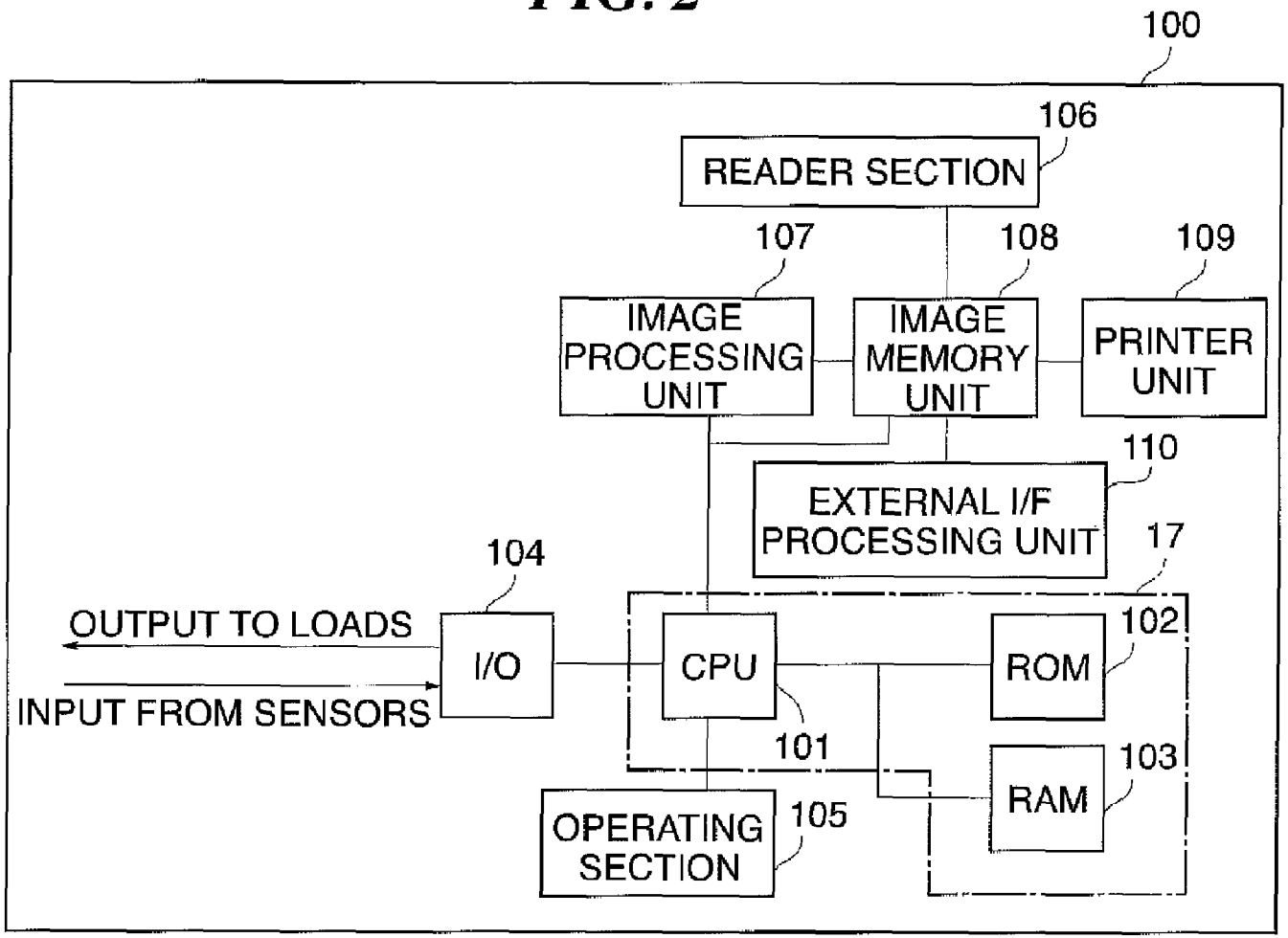
FIG. 2 is a schematic block diagram of a control block of the image forming apparatus.

FIG. 2 is a schematic block diagram of a control block of the image forming apparatus according to the embodiment.

The image forming apparatus 100 has illustrated components beside the CPU 101. The construction of each component will be described hereafter together with the operation thereof.

The CPU 101 is connected to a ROM 102 storing control programs, a work RAM 103 for performing processing operations, and an I/O port 104, via an address bus and a data bus. Connected to the I/O port 104 are various loads (not shown) for controlling the image forming apparatus, such as a motor and a clutch, and inputs (not shown) such as sensors for detecting a position of a sheet (recording medium). The CPU 101, the ROM 102, and the RAM 103 form the controller 17 appearing in FIG. 1.

The CPU 101 sequentially controls the inputs and outputs via the I/O port 104 according to the control programs stored in the ROM 102, and executes an image forming operation. Further, the CPU 101 is connected to an operating section 105, and controls a display unit and a key input unit, not shown, of the operating section 105.

The operator instructs the CPU 101 to switch between image-forming operation modes or displays, via the key input unit, and the CPU 101 displays the status of the image forming apparatus 100 or operation mode settings configured by key input.

Connected to the CPU 101 are an image processing unit 107 that processes an electric signal formed by conversion by a reader section 106, and an image memory unit 108 that stores processed images. Further, the image memory unit 108 is connected to a printer unit 109 and an external I/F processing unit 110.

As image forming conditions in the present embodiment, first, as for a dark potential, the potential of the photosensitive drum 9 is uniformly charged to a −700V by the primary electrostatic charger 16. The exposure by the semiconductor laser unit 6 is adjusted such that the potential at an image portion for FFh data becomes equal to −200V.

The digital value of the developing bias before being subjected to D/A conversion is 80h. The digital value of the developing bias is 5 V/1 bit but is configured to be controllable within a range of 0 V to −900V because of the specifications of a power transformer, not shown.

In the image forming apparatus thus configured, the semiconductor laser unit 6 forms an inspection pattern image on the photosensitive drum 9 based on an inspection pattern image signal generated by the image signal generation unit 13.

In doing this, after the controller 17 sets a plurality of different image forming conditions, the inspection pattern image formed on the sheet is read by the image pickup sensor 3, and the controller 17 corrects the set image forming conditions from the read data of the inspection pattern image.

As described above, since the inspection pattern image associated with the different image forming conditions is read, it is possible to grasp the state of image formation caused by complex image forming conditions which cannot be analyzed by the conventional reading of a predetermined inspection pattern image. Therefore, it is possible to correct the set image forming conditions to the optimum state in a short time period.

Further, the controller 17 sets the different image forming condition by changing the voltage of the developing bias power supply 14 which determines the developing bias of the developing unit 11. Therefore, it is possible to grasp the state of image formation dependent on the setting of the developing bias, which is difficult to analyze by the conventional reading of a predetermined inspection pattern image.

Moreover, the controller 17 sets a different image forming condition by changing the charged potential of the photosensitive drum 9 and the developing bias of the developing unit 11. Therefore, it is possible to grasp the state of image formation dependent on the setting of the developing bias and the setting of the charged potential of the photosensitive drum 9, which is difficult to analyze by the conventional reading of a predetermined inspection pattern image.

Also, the controller 17 sets a different image forming condition by changing the settings of the LUT 4. Therefore, it is possible to grasp the state of image formation dependent on the settings of the LUT 4, which is difficult to analyze by the conventional reading of a predetermined inspection pattern image.

Furthermore, the controller 17 sets a different image forming condition by changing the settings of the LUT 4 and the developing bias of the developing unit 11. Therefore, it is possible to grasp the state of image formation dependent on the settings of the LUT 4 and the setting of the developing bias, which is difficult to analyze by the conventional reading of a predetermined inspection pattern image.

Furthermore, the controller 17 sets a different image forming condition by changing the settings of the LUT 4, the developing bias of the developing unit 11, and the charged potential of the photosensitive drum 9. Therefore, it is possible to grasp the state of image formation dependent on the settings of the LUT 4, the setting of the developing bias, and that of the charged potential of the photosensitive drum 9, which is difficult to analyze by the conventional reading of a predetermined inspection pattern image.

Further, the controller 17 sets a different image forming condition by changing the illuminating light quantity of the laser beam of the semiconductor laser unit 6. Therefore, it is possible to grasp the state of image formation dependent on the setting of the illuminating light quantity of the laser beam of the semiconductor laser unit 6, which is difficult to analyze by the conventional reading of a predetermined inspection pattern image.

Further, the controller 17 sets a different image forming condition by changing the LUT 4 and the illuminating light quantity of the laser beam of the semiconductor laser unit 6. Therefore, it is possible to grasp the state of image formation dependent on the setting of the illuminating light quantity of the laser beam of the semiconductor laser unit 6 and the settings of the LUT 4, which is difficult to analyze by the conventional reading of a predetermined inspection pattern image.

Further, the controller 17 sets a different image forming condition by changing the LUT 4, the developing bias of the developing unit 11, the charged potential of the photosensitive drum 9, and the illuminating light quantity of the laser beam of the semiconductor laser unit 6. Therefore, it is possible to grasp the state of image formation dependent on the setting of the illuminating light quantity of the laser beam of the semiconductor laser unit 6, that of the developing bias of the developing unit 11, and the settings of the LUT 4, which is difficult to analyze by the conventional reading of a predetermined inspection pattern image. Similarly, it is possible to grasp the state of image formation caused by settings of the charged potential of the photosensitive drum 9.

Although in the present embodiment, the image writing means is implemented by the semiconductor laser unit 6, by way of example, the present invention is applied to an image forming apparatus having the image writing means implemented by a liquid crystal shutter, an LED head or the like. Further, although in the present embodiment, gradation control of the output image signal is area degradation control in a pulse width modulation method, it may be another suitable method.

Figure 3:
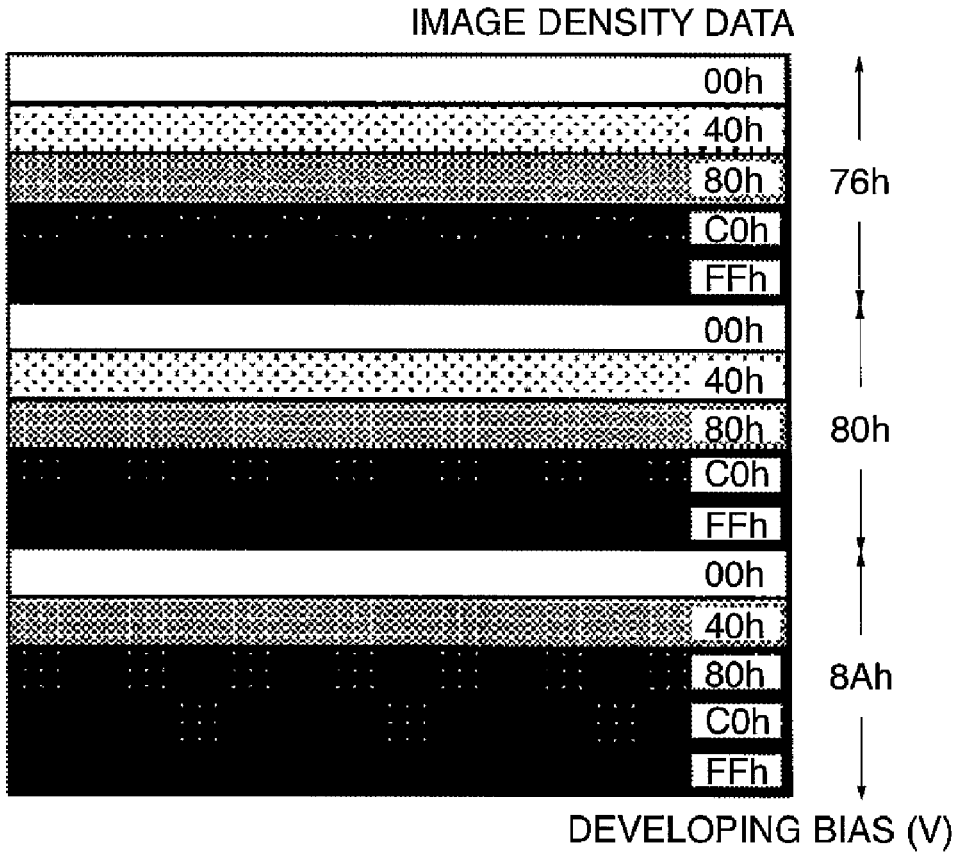
FIG. 3 is a view showing an example of a first inspection pattern image which an image signal generation device in FIG. 1 can generate.

FIG. 3 is a view showing an example of a first inspection pattern image which the image signal generation unit 13 in FIG. 1 can generate.

In FIG. 3, the inspection pattern image is divided into respective patterns of three levels, and each pattern is formed by white, black, and three halftones. The apparatus according to the present embodiment stores image data as 8-bit data, and hence the image signal is with 255-step gradations of 00h to FFh. The halftones in the aforementioned inspection pattern are 40h, 80h, and C0h of them.

In the present embodiment, the inspection pattern image is divided into the patterns of three levels, because the developing biases values (DC values) are different. The digital values corresponding thereto are 76h (−550V), 80h (−600V), and 8Ah(−650V).

Figure 4:
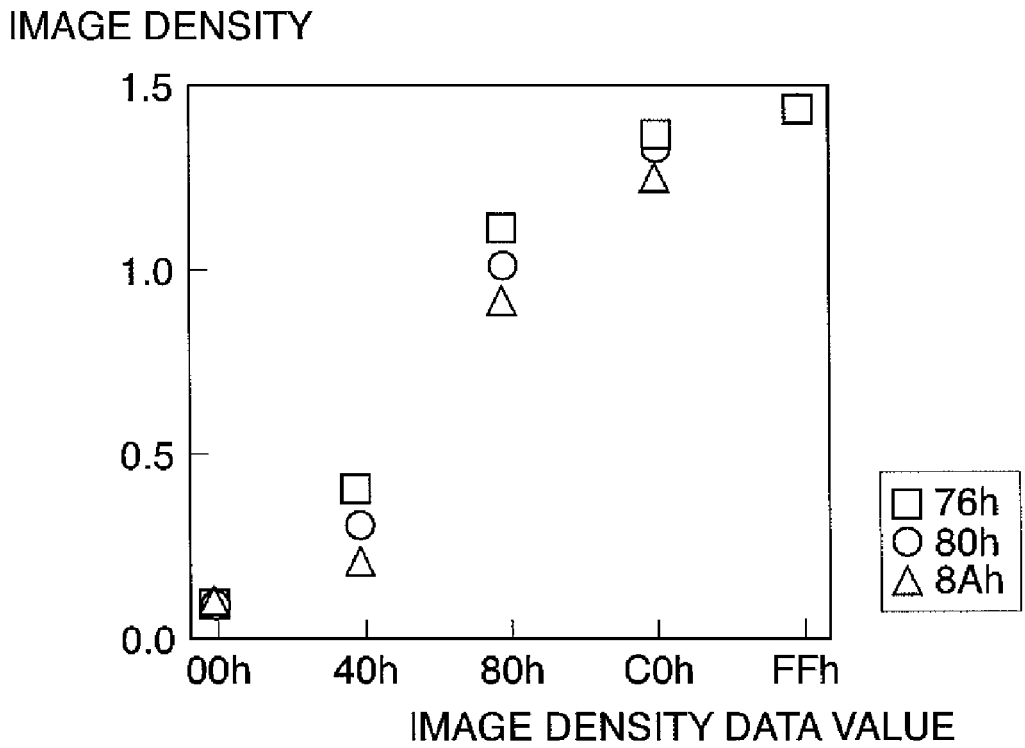
FIG. 4 is a view showing image density data of the first inspection pattern image shown in FIG. 3.

Next, after the output inspection pattern image is set at a predetermined position of the reader unit 106 appearing in FIG. 2, the reading of the image is started, to thereby obtain results of reading as shown in FIG. 4.

Figure 5:
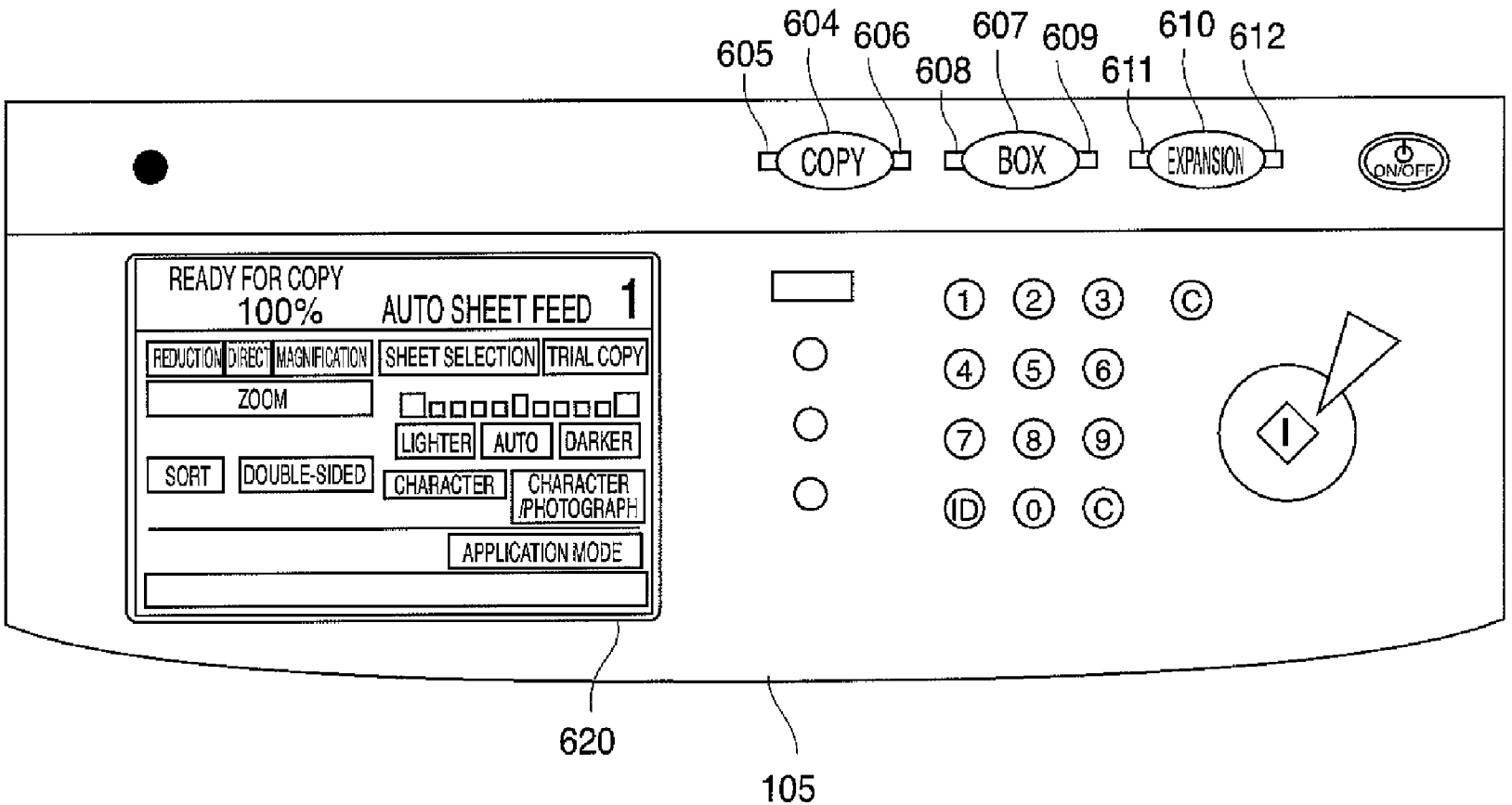
FIG. 5 is a view of the layout of an operating section appearing in FIG. 2.

FIG. 5 is a view of the layout of the operating section 105 appearing in FIG. 2.

As shown in FIG. 5, there are provided keys and LED displays 604 to 612 for switching the displayed screen on the operating section 105 to configure the functions of the copy operation and the system operation. The copy function key 604, the box function key 607, and the expansion function key 610 are each for switching the displayed screen to an operating screen for a function associated with the selected one of the keys. Each key is formed of a translucent key button, and contains a display lamp (not shown) formed e.g. by an LED.

By depressing any of these keys to select the associated operating screen, the lamp thereunder is lighted. Only the lamp inside the key operated for selection of the display of the operating screen is caused to be lighted or turned on, and the lamps under the other keys are caused to be turned off. Further, the LEDs 606, 609, and 612 are provided on the respective right sides of the keys 604, 607 and 612, and these LEDs 606, 609, and 612 each indicate the operating state of the associated function by the controlled lighting thereof.

For example, the LED 606 associated with the copy function is caused to be off during standby for a copy operation, and as shown in FIG. 5, when the apparatus is in copy operation, it is caused to blink. Further, when an image for copying is stored in a hard disk (not shown) of the image memory unit 108 and the printing for copying is not in operation, the LED 605 is caused to light up.

The LEDs 605, 608, and 611 are provided on the respective left sides of the keys 604, 607 and 612, and these LEDs 605, 608, and 611 each indicate the occurrence of abnormality of the associated function by the controlled lighting thereof. For example, when the LED 605 associated with the copy function is caused to blink when there occurs an abnormality, such as interruption due to no sheet feed, jamming, or the like.

At this time, by depressing the copy function key 604 to switch the display of the operating section 105 to an operating screen for the copy operation, the state of the copy operation is displayed on the display panel 620, whereby the user can check details of the abnormal state. These function-switching keys can be depressed at any time irrespective of the operating state of the apparatus.

Figure 6:
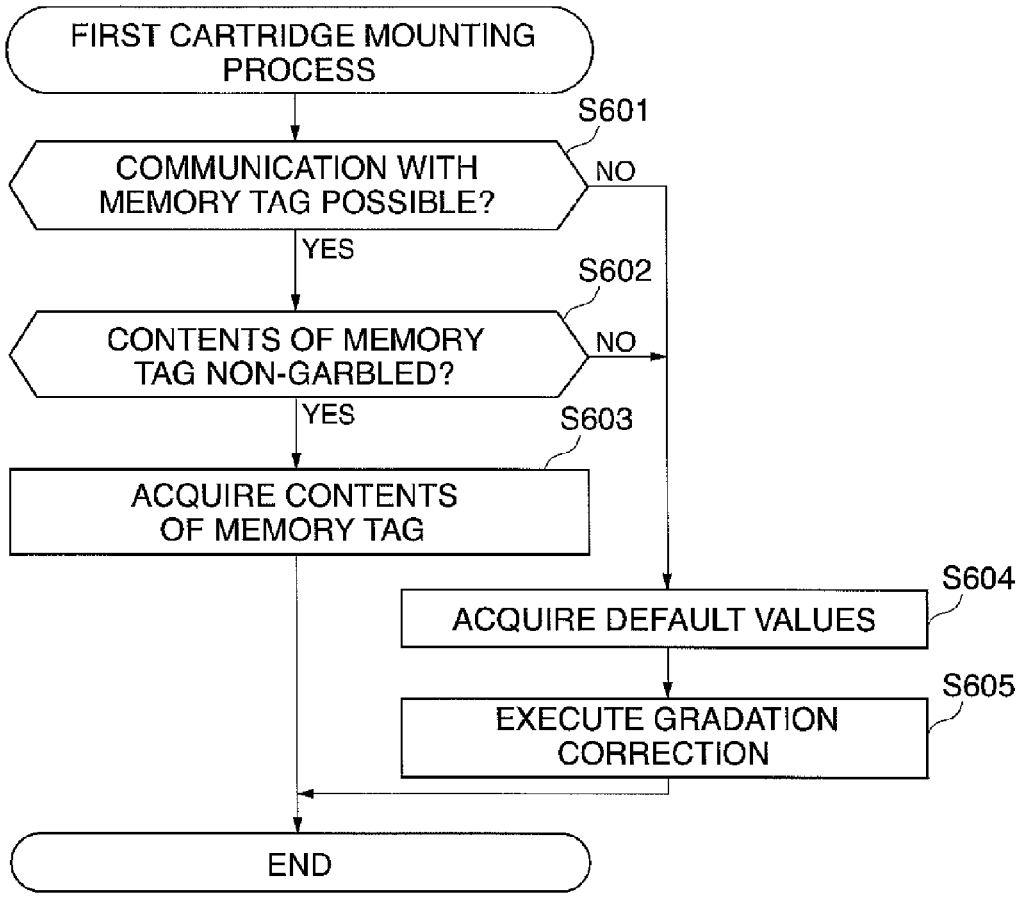
FIG. 6 is a flowchart of a first cartridge mounting process executed by the image forming apparatus.

FIG. 6 is a flowchart of a first cartridge mounting process executed by the image forming apparatus.

The process is executed by the controller 17 appearing in FIG. 2. The cartridge (e.g. a drum cartridge) as a replaceable unit is assumed to be equipped with a memory tag as a memory device as a prerequisite.

Figure 7:
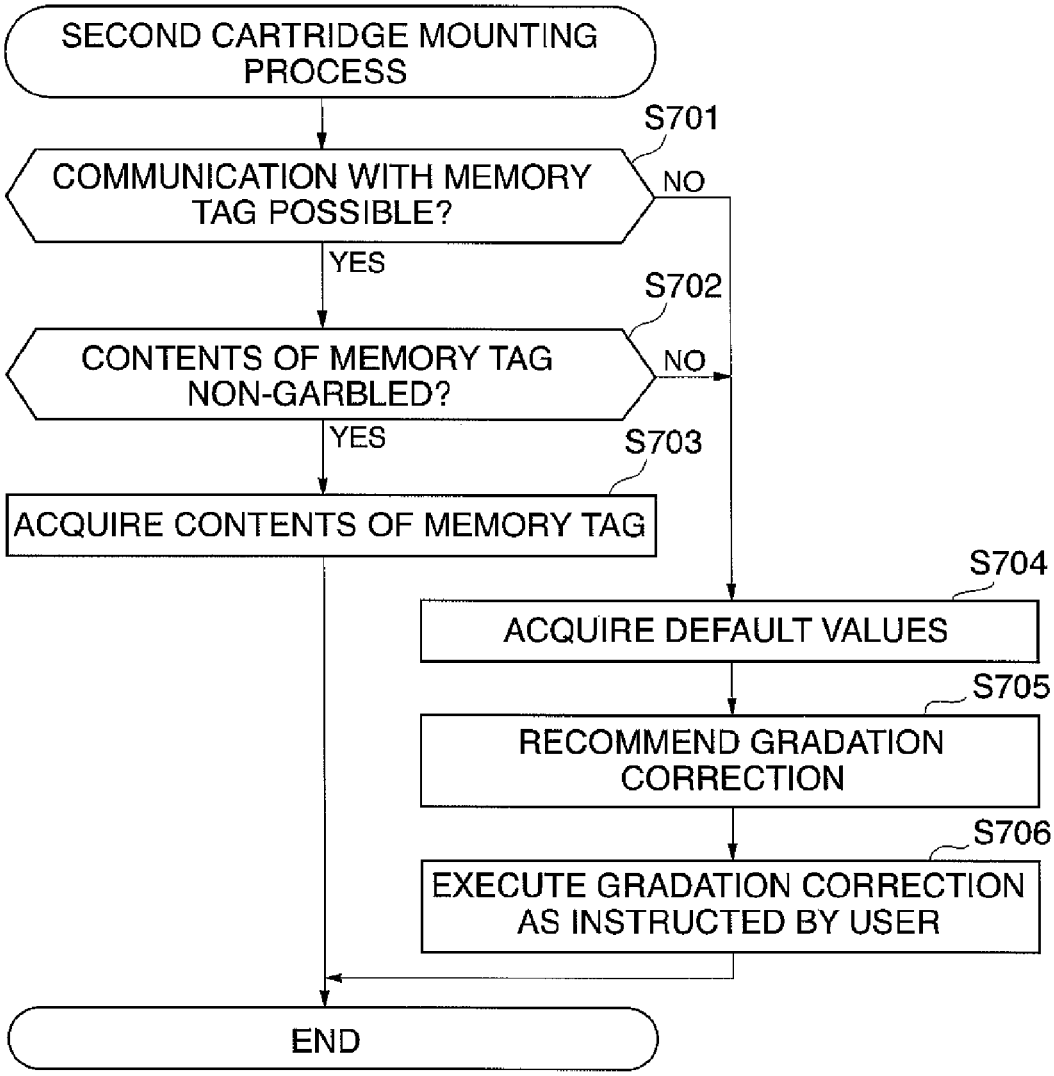
FIG. 7 is a flowchart of a second cartridge mounting process executed by the image forming apparatus.

In FIG. 7, when a door (not shown) is closed, it is regarded that the cartridge is mounted, and the present process is started. The main unit (image forming apparatus 100) and the memory tag of the cartridge communicate with each other, and it is determined whether or not the communication is possible (step S601).

Next, if the memory tag which is not faulty is equipped, and hence it is determined in the step S601 that the communication is possible, it is determined whether or not the contents of the memory tag are garbled data (step S602). In the step S602, identification information stored in the memory tag and identification information stored in the ROM 102 are compared with each other. If it is determined that the data is not garbled, the contents of the information stored in the memory tag are stored in the RAM 103 (step S603), the present process is terminated.

If it is determined that the faulty memory tag is equipped, and hence it is determined in the step S601 that the communication is impossible, the default process information stored in the ROM 102 in advance is stored in the RAM 103 (step S604). Based on the process information, the gradation correction is executed (step S605), and based on the result of the gradation correction, the process information stored in the RAM 103 is updated. The process information is intended to mean various parameters (various setting values) required by the image forming apparatus 100 in performing a printing operation (image forming operation) using a cartridge mounted thereon. The process information includes, for example, parameter values necessary for optimally configuring the charging of the photosensitive drum 9 and image transfer when using the cartridge mounted on the image forming apparatus 100. The process information of standard values of the parameters are originally stored in the ROM 102 in advance and read into the RAM 103. When a normal or non-defective cartridge is mounted in the image forming apparatus, the process information is received from the memory tag thereof, to update the process information of the default (standard) values having been read into the RAM 103 from the ROM 102, as mentioned above.

Now, a description will be given of a case where a cartridge is mounted which is equipped with a memory tag communicable but storing garbled data. If the door (not shown) is closed, it is determined in the step S601 that communication is possible. Next, it is determined in the step S602 that the data is garbled, and the default process information held in the ROM 102 is stored in the RAM 103 (step S604). Based on the process information, the gradation correction is executed (step S605), and based on the result of the gradation correction, the process information stored in the RAM 103 is updated.

According to the above-described process, even if the memory tag of a cartridge is faulty, the gradation correction is executed using the default process information held in the ROM 102, whereby it is possible to perform image formation under appropriate conditions.

FIG. 7 is a flowchart of a second cartridge mounting process executed by the image formatting apparatus shown.

This process is executed by the controller 17. It is assumed that a cartridge (e.g. a drum cartridge) is equipped with a memory tag.

As shown in FIG. 7, when the door (not shown) is closed, it is regarded that a cartridge is mounted, to start the present process. An attempt is made to perform communication between the main unit (image forming apparatus 100) and the memory tag of the cartridge to determine if the communication is possible (step S701).

Next, if the cartridge is equipped with a memory tag which is not faulty, and hence it is determined in the step S701 that the communication is possible, it is determined in a step S702 whether or not the contents of the memory tag are garbled. In this determination, the identification information stored in the memory tag and that stored in the ROM 102 are compared with each other. If it is determined that the data is not garbled, the information in the memory tag is stored in the RAM 103 (step S703), followed by terminating the present process.

If the cartridge is equipped with a faulty memory tag, and hence it is determined in the step S701 that the communication is impossible, the default process information stored in the ROM 102 is stored in the RAM 103 (step S704).

Figure 8:
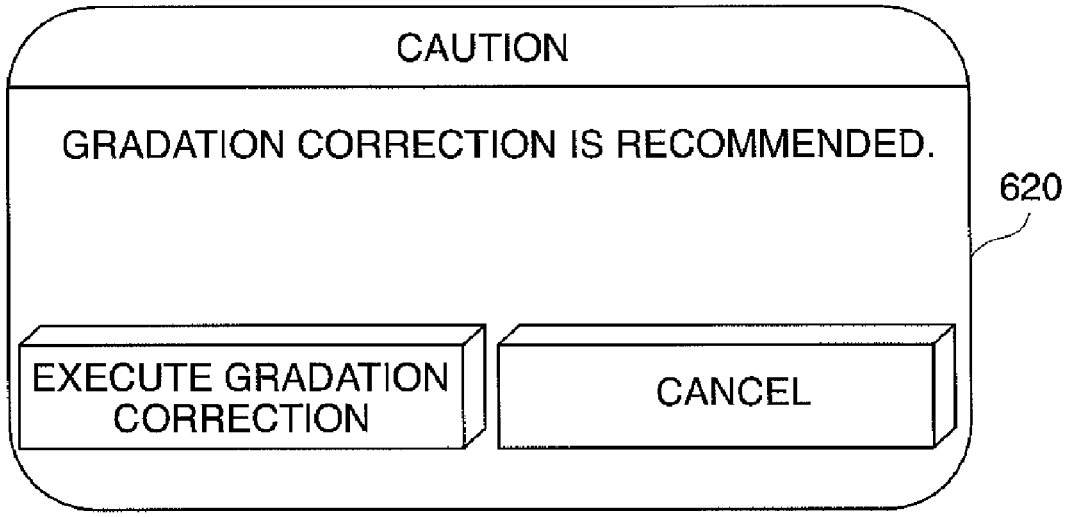
FIG. 8 is a view of a message urging the user to perform correction in the second cartridge mounting process in FIG. 7.

Then, a message urging gradation correction, shown in FIG. 8, is displayed on the display panel 620 (step S705). The user executes automatic gradation correction as required (step S706), and based on the result of the gradation correction, the process information stored in the RAM 103 is updated.

Next, a description will be given of a case where a cartridge is mounted which is equipped with a memory tag communicable but storing garbled data. If the door (not shown) is closed, it is determined in the step S701 that the communication is possible. Next, it is determined in the step S702 that the data is garbled, and the default process information held in the ROM 102 is stored in the RAM 103 (step S704).

Then, the message urging gradation correction shown in FIG. 8 is displayed on the display panel 620 (step S705). The user executes automatic gradation correction as required (step S706), and based on the result of the gradation correction, the process information stored in the RAM 103 is updated.

According to the above-described process, even if the memory tag of a cartridge is faulty, the gradation correction is executed using the default process information held in the ROM 102, whereby it is possible to perform image formation under appropriate conditions.

It is to be understood that the object of the present invention may also be accomplished by supplying a system or an apparatus with a storage medium in which a program code of software, which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and therefore the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program may be downloaded via a network.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2006-327115 filed Dec. 4, 2006, which is hereby incorporated by reference herein in its entirety.

What is claimed is:

1. An image forming apparatus on which a replaceable unit equipped with a memory device storing information is removably mounted, comprising:

a failure determination unit configured to determine whether or not the memory device is faulty; and an image adjustment unit configured to execute image adjustment if it is determined by said failure determination unit that the memory device is faulty, wherein after setting a plurality of image forming conditions different from each other which are set when a predetermined inspection pattern image in which image density is stepwise varied is formed on a photosensitive member, said image adjustment unit is configured to correct the image forming conditions based on results of reading of the inspection pattern image formed on a recording medium.

2. An image forming apparatus as claimed in claim 1, wherein said failure determination unit is configured to determine whether or not the memory device is communicable or not, or stores garbled data or not.

3. An image forming apparatus on which a replaceable unit equipped with a memory device storing information is removably mounted, comprising:

a failure determination unit configured to determine whether or not the memory device is faulty; and an image adjustment-recommending unit configured to recommend image adjustment if it is determined by said failure determination unit that the memory device is faulty, wherein after setting a plurality of image forming conditions different from each other which are set when a predetermined inspection pattern image in which image density is stepwise varied is formed on a photosensitive member, said image adjustment-recommending unit is configured to recommend correction of the image forming conditions based on results of reading of the inspection pattern image formed on a recording medium.

4. An image forming apparatus as claimed in claim 3, wherein said failure determination unit is configured to determine whether or not the memory device is communicable or not, or stores garbled data or not.

5. A method of controlling an image forming apparatus on which a replaceable unit equipped with a memory device storing information is removably mounted, comprising:

a failure determination step of determining whether or not the memory device is faulty; and an image adjustment step of executing image adjustment if it is determined in said failure determination step that memory device is faulty, wherein after setting a plurality of image forming conditions different from each other which are set when a predetermined inspection pattern image in which image density is stepwise varied is formed on a photosensitive member, said image adjustment step includes correcting the image forming conditions based on results of reading of the inspection pattern image formed on a recording medium.

6. A method of controlling an image forming apparatus on which a replaceable unit equipped with a memory device storing information is removably mounted, comprising:

a failure determination step of determining whether or not the memory device is faulty; and an image adjustment-recommending step of recommending image adjustment if it is determined in said failure determination step that the memory device is faulty, wherein after setting a plurality of image forming conditions different from each other which are set when a predetermined inspection pattern image in which image density is stepwise varied is formed on a photosensitive member, said image adjustment-recommending step includes recommending correction of the image forming conditions based on results of reading of the inspection pattern image formed on a recording medium.

* * * * *